US009597537B2

(12) United States Patent
Inoue et al.

(10) Patent No.: US 9,597,537 B2
(45) Date of Patent: Mar. 21, 2017

(54) INJECTION HEAD HAVING SILENCING FUNCTION FOR GAS TYPE FIRE EXTINGUISHER

(75) Inventors: Yasushi Inoue, Itami (JP); Masahiro Yabushita, Itami (JP)

(73) Assignee: KOATSU CO., LTD., Hyogo Pref. (JP)

( * ) Notice: Subject to any disclaimer, the term of this patent is extended or adjusted under 35 U.S.C. 154(b) by 723 days.

(21) Appl. No.: 13/463,204

(22) Filed: May 3, 2012

(65) Prior Publication Data

US 2013/0292140 A1 Nov. 7, 2013

(51) Int. Cl.
*A62C 31/02* (2006.01)
*A62C 99/00* (2010.01)

(52) U.S. Cl.
CPC ..... *A62C 31/02* (2013.01); *A62C 99/0018* (2013.01)

(58) Field of Classification Search
CPC ... A62C 35/023; A62C 3/0207; A62C 13/003; A62C 13/02; A62C 13/22; A62C 13/66; A62C 13/70; A62C 13/74; A62C 35/645; A62C 31/02; A62C 99/0018
USPC ..... 169/11
See application file for complete search history.

(56) References Cited

U.S. PATENT DOCUMENTS

| | | | | |
|---|---|---|---|---|
| 3,339,668 | A * | 9/1967 | Trainor | F16L 55/02781 181/237 |
| 3,949,828 | A * | 4/1976 | Frochaux | G10K 11/161 181/230 |
| 5,767,459 | A * | 6/1998 | Sell | 181/258 |
| 7,753,167 | B2 * | 7/2010 | Fukano et al. | 181/230 |
| 2012/0205128 | A1 † | 8/2012 | Goto | |

FOREIGN PATENT DOCUMENTS

| | | | | |
|---|---|---|---|---|
| JP | WO2011049002 | A1 * | 4/2011 | A62C 31/02 |
| JP | WO2011049002 | A2 * | 4/2011 | A62C 31/02 |
| JP | 2011-255152 | † | 12/2011 | |

* cited by examiner
† cited by third party

*Primary Examiner* — Arthur O Hall
*Assistant Examiner* — Juan C Barrera
(74) *Attorney, Agent, or Firm* — Wenderoth, Lind & Ponack, L.L.P.

(57) ABSTRACT

To present an injection head having silencing function for gas type fire extinguisher capable of reducing the noise generated upon release of fire extinguishing gas.
In a gas type fire extinguisher using a fire extinguishing gas, a silencer 3A is disposed in an injection head 1A installed for releasing a fire extinguishing gas into a fire extinguishing area.

12 Claims, 7 Drawing Sheets

INJECTION HEAD HAVING SILENCING FUNCTION FOR GAS TYPE FIRE EXTINGUISHER

TECHNICAL FIELD

The present invention relates to an injection head installed on a ceiling or a wall for releasing a fire extinguishing gas into a fire extinguishing area, in a gas type fire extinguisher using fire extinguishing gas such as carbon dioxide, nitrogen, or fluorine compound, and more particularly to an injection head having silencing function for gas type fire extinguisher designed to reduce the noise level generated upon release of fire extinguishing gas.

BACKGROUND ART

In a gas type fire extinguisher using fire extinguishing gas such as carbon dioxide, nitrogen, or fluorine compound, when the gas type fire extinguisher is put in action at the time of extinguishing a fire, the fire extinguishing gas is released so that the fire extinguishing gas concentration in the fire extinguishing area may reach an extinction concentration in about 1 minute (about 10 seconds in the case of fire extinguishing as of fluorine compound).

At this time, the fire extinguishing gas is released from an injection head installed on a ceiling or a wall for releasing the fire extinguishing gas into a fire extinguishing area, and conventionally, the injection head for gas type fire extinguisher has, as shown in FIG. 9 (*a*), an orifice 2 provided at an outlet of an injection head 10A connected to a piping 4 in which a fire extinguishing gas is supplied, and the fire extinguishing gas is released from the orifice 2 directly into the fire extinguishing area, or as shown in FIG. 9 (*b*), an orifice 2 and a conical deflector (deflection member) 5 are provided at an outlet of an injection head 10B connected to a piping 4 in which a fire extinguishing gas is supplied, and the fire extinguishing gas released from the orifice 2 is deflected by the deflector (deflection member) 5, and is released into the fire extinguishing area, or as shown in FIG. 9 (*c*), an orifice (not shown) and a conical tubular horn (diffusion member) 6 are provided at an outlet of an injection head 10C, and the fire extinguishing gas released from the orifice is diffused by the horn (diffusion member) 6, and is released into the fire extinguishing area.

In this manner, the conventional injection heads 10A, 10B, 10C for gas type fire extinguisher were designed to release a same volume of fire extinguishing gas from each one of a plurality of injection heads usually installed in the fire extinguishing area, and the flow rate of the fire extinguishing gas released from the injection heads is limited by the orifice 2, and because of this mechanism, when the fire extinguishing gas is released from the injection heads, it is known that noise of high level (specifically 120 dB or higher) is generated.

SUMMARY OF THE INVENTION

Problems to be Solved by the Invention

In this case, when the gas type fire extinguisher is put in action, it is supposed that no one is present in the fire extinguishing area, and nothing is taken into consideration about the noise generated when the fire extinguishing gas is released from the injection head, and no countermeasures have been taken.

However, actually, some people may be late and left over in the fire extinguishing area when the gas type fire extinguisher is put in action, or the noise generated by release of fire extinguishing gas from the injection heads may disturb the surrounding people adversely, and on the basis of such findings, it has been taught conclusively that it is required to reduce the noise generated by release of fire extinguishing gas.

It is hence an object of the present invention to present an injection head having silencing function for gas type fire extinguisher designed to reduce the noise level generated upon release of fire extinguishing gas, by solving the problems neither noticed nor remedied in the conventional injection heads for gas type fire extinguisher.

Means for Solving the Problems

To achieve the object, the injection head of the present invention having silencing function for gas type fire extinguisher includes silencing means provided in the injection head installed for releasing fire extinguishing gas into a fire extinguishing area in a gas type fire extinguisher using fire extinguishing gas.

In this case, the silencing means may be composed of a silencer disposed in the injection head.

The silencing means may be also formed in an orifice shape.

The silencing means may be composed of gas-permeable fibrous or porous material disposed at an outlet of an orifice.

The pore size of voids in the fibrous or porous material may be varied in a gas passing direction, and, for example, the pore size of voids in the fibrous or porous material may be varied to be smaller in a gas passing direction.

Effects of the Invention

In the injection head having silencing function for gas type fire extinguisher of the present invention, silencing means is provided in the injection head installed for releasing fire extinguishing gas into a fire extinguishing area in a gas type fire extinguisher using fire extinguishing gas, and hence the noise level generated upon release of fire extinguishing gas can be suppressed, and if some people are late and left over in the fire extinguishing area at the time of action of the gas type fire extinguisher, it is possible to prevent from causing a panic due to noise generated by release of fire extinguishing gas, or to prevent from failing to catch announcement urging to evacuate, or from disturbing adversely the surrounding people by the noise generated by release of fire extinguishing gas from the injection head.

Preferably, the silencing means is composed of a silencer disposed in the injection head, and the silencing means may be disposed easily, and the silencer may be designed appropriately depending on the required degree of silencing or the state of installation, so that a required silencing performance may be obtained securely.

Preferably, the silencing means is also formed in an orifice shape, and the silencing means may be simple in structure, and the injection head may be formed in a compact design, and it may be directly applied in an existing device.

Preferably, the silencing means is composed of a gas-permeable fibrous or porous material disposed at an outlet of an orifice, and the silencing means may be simple in structure, and the injection head may be formed in a compact design, and it may be directly applied in an existing device.

Preferably, the pore size of voids in the fibrous or porous material may be varied in a gas passing direction, and, for example, the pore size of voids in the fibrous or porous material may be varied to be smaller in a gas passing direction, and therefore a great silencing effect may be obtained.

PREFERRED EMBODIMENTS OF THE INVENTION

Herein, preferred embodiments of an injection head having silencing function for gas type fire extinguisher of the present invention are described specifically below while referring to the accompanying drawings.

Embodiment 1

Figure 1:
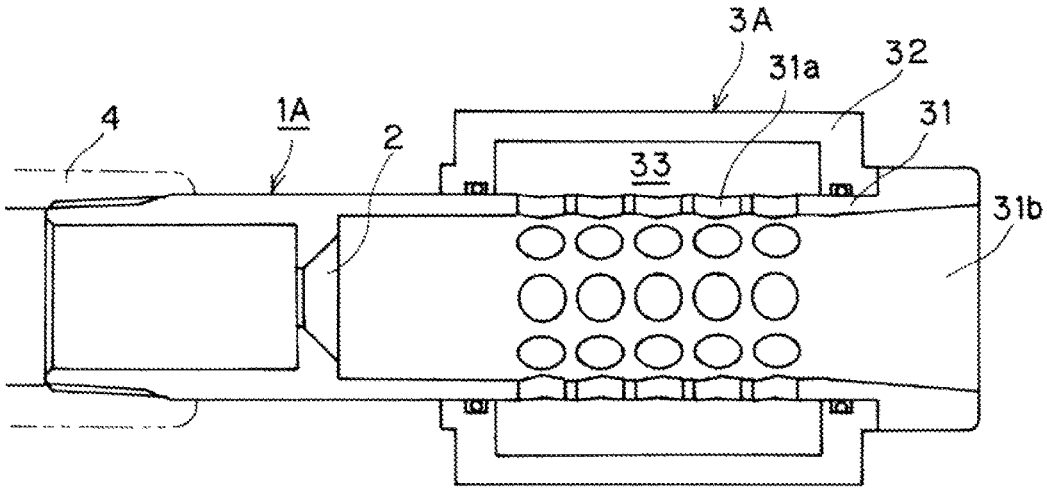
FIG. 1 is an explanatory diagram of a first embodiment of an injection head having silencing function for gas type fire extinguisher of the present invention.

FIG. 1 shows a first embodiment of an injection head having silencing function for gas type fire extinguisher of the present invention.

This injection head 1A having silencing function for gas type fire extinguisher includes an orifice 2 provided in the injection head 1A connected to a piping 4 in which a fire extinguishing gas is supplied, and a silencer 3A is disposed at its leading end side, and the fire extinguishing gas is released into a fire extinguishing area by way of this silencer 3A.

In this embodiment, the silencer 3A has multiple perforations 31*a* formed in the inner circumference of an inner tube 31 as passage of fire extinguishing gas, and the outer circumference is covered with an outer tube 32.

The silencer 3A is designed to weaken impulse waves generated by expansion of the fire extinguishing gas, and to suppress the noise generated upon release of the fire extinguishing gas.

More specifically, if the fire extinguishing gas passing through the orifice 2 of the injection head 1A is directly released into the atmosphere, the fire extinguishing gas is expanded suddenly, and noise is generated, but in the injection head 1A of the embodiment, the multiple perforations 31*a* are formed around the inner tube 31 as passage of fire extinguishing gas, and its outer circumference is covered with the outer tube 32, and therefore the fire extinguishing gas passing the orifice 2 is gradually expanded while passing through the inner tube 31, and the fire extinguishing gas is not expanded suddenly when released into the atmosphere from openings 31*b* formed at the leading end of the inner tube 31, and the impulse waves generated by expansion of the fire extinguishing gas are weakened, thereby suppressing the noise generated when the fire extinguishing gas is released.

In this case, the size and quantity (porosity) of the perforations 31*a* formed around the inner tube 31 may be determined appropriately depending on the pressure and flow rate of the fire extinguishing gas.

A space 33 formed between the inner tube 31 and the outer tube 32 may be either filled, as required, with glass wool, rock wool, steel wool, other metallic wool, nonwovens of synthetic fiber or natural fiber, porous material (including sinter and granules) of inorganic material (including metal, oxide of metal, hydroxide of metal), synthetic resin foamed material, rectifier of honeycomb structure, and other gas-permeable fiber or porous material capable of eliminating disturbance of gas stream, or may be kept vacant.

The outer tube 32 may be made of sintered metal.

Figure 9:
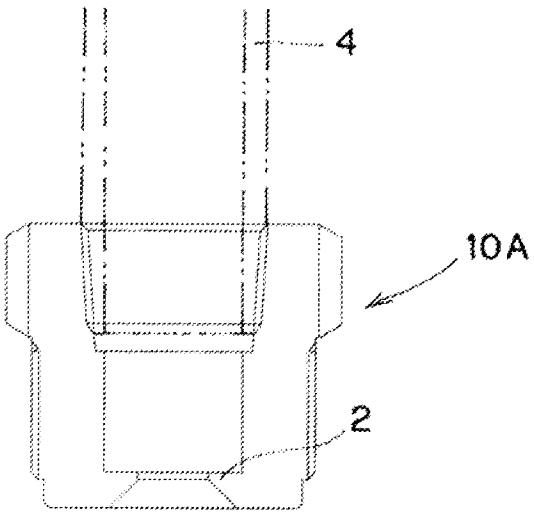
FIG. 9 is an explanatory diagram of a conventional injection head for gas type fire extinguisher.
Figure 9:
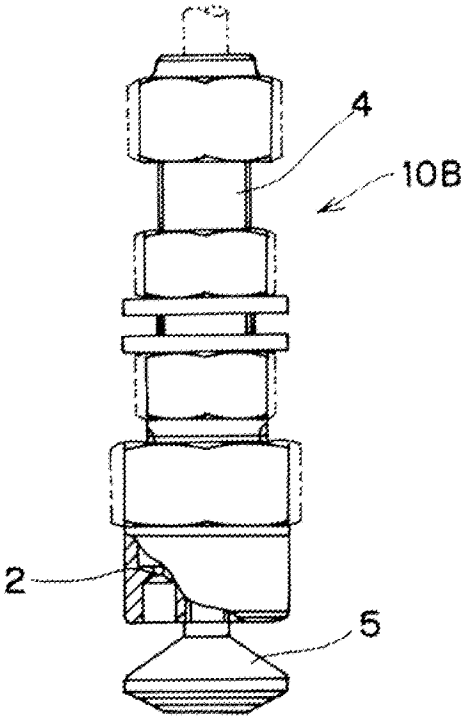
Figure 9:
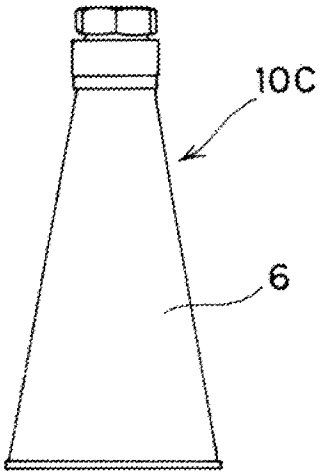

In the embodiment, the fire extinguishing gas is designed to be released into the fire extinguishing area from the openings 31*b* formed at the leading end of the inner tube 31, but as shown in FIG. 9 (*b*), a conical deflector (deflection member) 5 is provided, and the fire extinguishing gas released from the openings 31*b* formed at the leading end of the inner tube 31 is deflected by the deflector (deflection member) 5, or as shown in FIG. 9 (*c*), a conical tubular horn (diffusion member) 6 is provided, and the fire extinguishing gas released from the openings 31*b* formed at the leading end of the inner tube 31 is diffused by the horn (diffusion member) 6, and is released into the fire extinguishing area.

In this injection head 1A having silencing function for gas type fire extinguisher, the silencer 3A is provided in the injection head 1A installed for releasing fire extinguishing gas into a fire extinguishing area in a gas type fire extinguisher using fire extinguishing gas, and hence the noise level generated upon release of fire extinguishing gas can be suppressed, and if some people are late and left over in the fire extinguishing area at the time of action of the gas type fire extinguisher, it is possible to prevent from causing a panic due to noise generated by release of fire extinguishing gas, or to prevent from failing to catch announcement urging to evacuate, or from disturbing adversely the surrounding people by the noise generated by release of fire extinguishing gas from the injection head.

In addition, in the silencer 3A disposed in the injection head 1A, since the silencer 3A can be disposed easily as silencing means, and the silencer 3A can be designed appropriately depending on the required degree of silencing or the state of installation, and a necessary silencing performance can be obtained securely.

Embodiment 2

Figure 2:
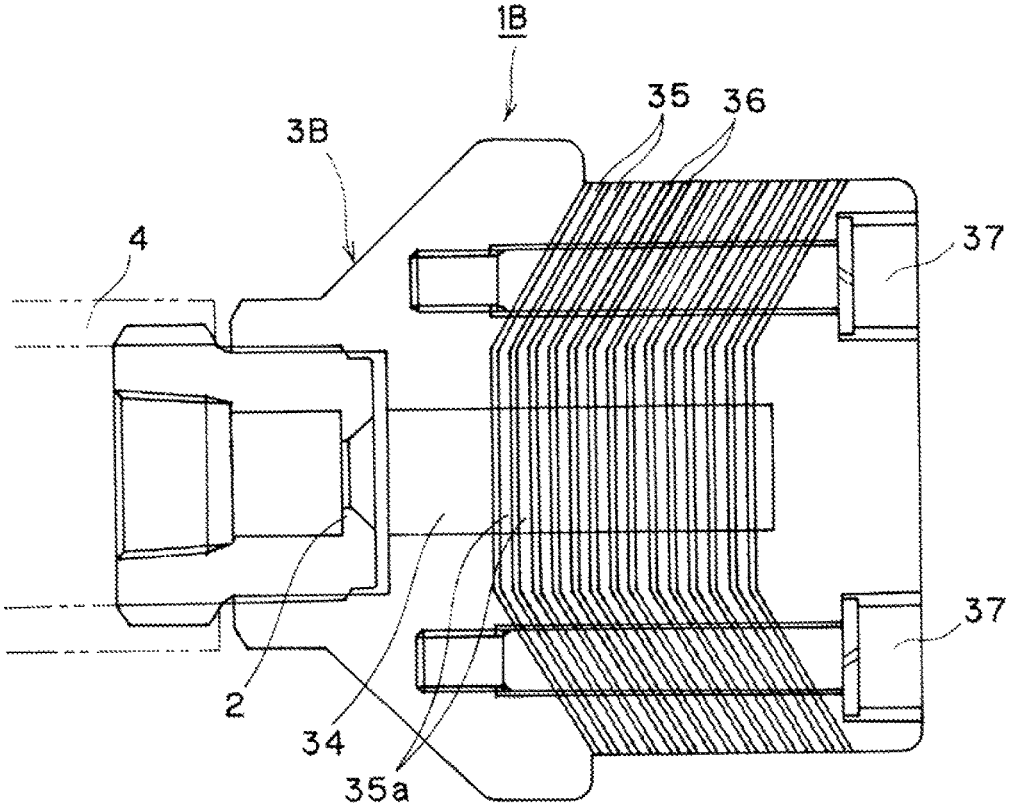
FIG. 2 is an explanatory diagram of a second embodiment of the injection head having silencing function for gas type fire extinguisher of the present invention.

FIG. 2 shows a second embodiment of an injection head having silencing function for gas type fire extinguisher of the present invention.

This injection head 1B having silencing function for gas type fire extinguisher includes an orifice 2 provided in the injection head 1B connected to a piping 4 in which a fire extinguishing gas is supplied, and a silencer 3B is disposed at its leading end side, and the fire extinguishing gas is released into a fire extinguishing area by way of this silencer 3B.

In this embodiment, the silencer 3B has a plurality of disk-shaped plate members 35 having perforations 35*a* communicating with internal passages 34 in the central part, fixed with bolts 37 at proper intervals by means of spacers (not shown) so that the fire extinguishing gas may be released in the radial direction from the internal passages 34 of passages of fire extinguishing gas, and release passages 36 are formed so that the fire extinguishing gas may be released in the radial direction.

This silencer 3B is intended to weaken the impulse waves caused by expansion of fire extinguishing gas, and suppress the noise generated upon release of the fire extinguishing gas.

More specifically, if the fire extinguishing gas passing through the orifice 2 of the injection head 1B is directly released into the atmosphere, the fire extinguishing gas is expanded suddenly, and noise is generated, but in the injection head 1B of the embodiment, the plurality of disk-shaped plate members 35 having perforations 35*a* communicating with internal passages 34 in the central part are fixed with bolts 37 at proper intervals by means of spacers (not shown), and the release passages 36 are formed so that the fire extinguishing gas may be released in the radial direction, and therefore the fire extinguishing gas passing the orifice 2 is gradually expanded while passing through the release passages 36, and the fire extinguishing gas is not expanded suddenly when released into the atmosphere from the release passages 36, and the impulse waves generated by expansion of the fire extinguishing gas are weakened, thereby suppressing the noise generated when the fire extinguishing gas is released.

In this case, the size and quantity of the disk-shaped plate members 35 and the release passages 36 may be determined appropriately depending on the pressure and flow rate of the fire extinguishing gas.

Other actions of the injection head 1B having silencing function for gas type fire extinguisher of the embodiment are similar to those of the injection head 1A having silencing function for gas type fire extinguisher of the first embodiment.

Embodiment 3

Figure 3:
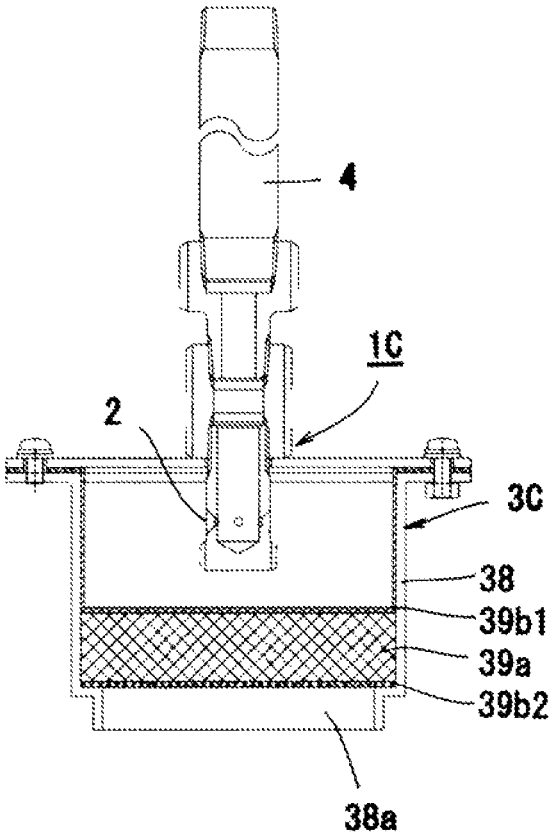
FIG. 3 is an explanatory diagram of a third embodiment of the injection head having silencing function for gas type fire extinguisher of the present invention.

FIG. 3 shows a third embodiment of an injection head having silencing function for gas type fire extinguisher of the present invention.

This injection head 1C having silencing function for gas type fire extinguisher includes a plurality of (four in the embodiment) orifices 2 opened in the lateral direction in the injection head 1C connected to a piping 4 in which a fire extinguishing gas is supplied, and a silencer 3C is disposed so as to cover the outer circumference thereof, and the fire extinguishing gas is released into a fire extinguishing area by way of this silencer 3C.

In this embodiment, the silencer 3C is composed of a tubular casing 38 provided on the outer circumference of the orifice 2, and a filler 39*a* disposed in an opening 38*a* of the casing 38 as the passage of fire extinguishing gas.

This silencer 3C is intended to weaken the impulse waves caused by expansion of fire extinguishing gas, and suppress the noise generated upon release of the fire extinguishing gas.

More specifically, if the fire extinguishing gas passing through the orifice 2 of the injection head 1C is directly released into the atmosphere, the fire extinguishing gas is expanded suddenly, and noise is generated, but in the injection head 1C of the embodiment, the outer circumference of the orifice 2 as the passage of fire extinguishing gas is covered with the casing 38, and the opening 38*a* of the casing 38 is filled with the filler 39*a*, and therefore the fire extinguishing gas passing through the orifice 2 is expanded gradually while passing through the casing 38 and further the filler 39*a*, is hence prevented from being expanded suddenly when released into the atmosphere from the opening 38*a* of the casing 38, and the impulse waves generated by expansion of the fire extinguishing gas are weakened, thereby suppressing the noise generated when the fire extinguishing gas is released.

In this case, the filler 39*a* is made of glass wool, rock wool, steel wool, other metallic wool, nonwovens of synthetic fibers and natural fibers, porous matter (including sinter and granule) of inorganic materials (including metal, oxide of metal, and hydroxide of metal), synthetic resin foamed matter, rectifier of honeycomb structure, and other gas-permeable fibrous or porous materials capable of eliminating disturbance of air stream.

In addition, to prevent the filler 39*a* from scattering, depending on the material of the filler 39*a*, it may be held from both sides by holding plates 39*b*1, 39*b*2, such as punching metal, expanding metal, sinter metal, other plate material, rectifier of honeycomb structure, or others.

To enhance the silencing effect further, as required, the inner circumference and/or outer circumference of the casing 38 may be covered with a sound absorbing material, or the casing 38 itself may be made of sinter metal.

Other actions of the injection head 1C having silencing function for gas type fire extinguisher of the embodiment are similar to those of the injection head 1A having silencing function for gas type fire extinguisher of the first embodiment.

The form of disposition of the filler 39*a* of the injection head 1C having silencing function for gas type fire extinguisher of the third embodiment is not limited to the type described in the embodiment, but may be formed in various types as described below.

Figure 4:
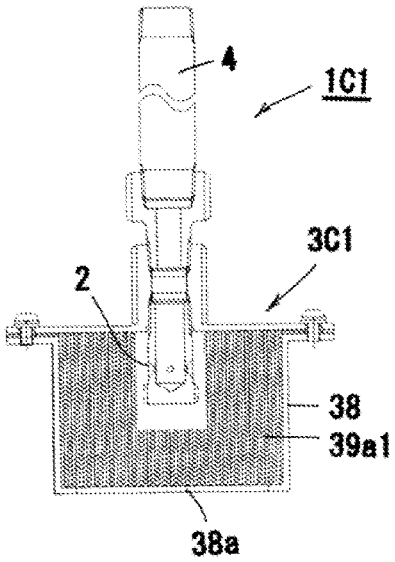
FIG. 4 is an explanatory diagram of a first modified example of the third embodiment of the injection head having silencing function for gas type fire extinguisher of the present invention.
Figure 4:
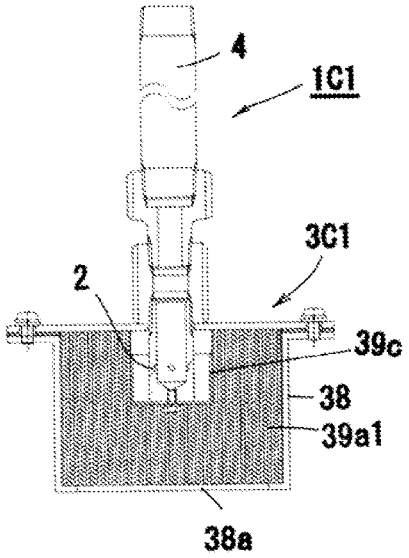

FIG. 4 shows a first modified example of the third embodiment.

In this injection head 1C1 having silencing function for gas type fire extinguisher, a silencer 3C1 is composed of a tubular casing 38 having an opening 38*a* as the passage of fire extinguishing gas, provided on the outer circumference of a plurality of (four in the embodiment) orifices 2 opened in the lateral direction, and a filler 39*a*1 with a bottom disposed in the casing 38 so as to cover the outer circumference of the opening directed to the lateral direction of the orifices 2 across a slight space.

This silencer 3C1 is intended to weaken the impulse waves caused by expansion of fire extinguishing gas, and suppress the noise generated upon release of the fire extinguishing gas.

More specifically, if the fire extinguishing gas passing through the orifices 2 of the injection head 1C1 is directly released into the atmosphere, the fire extinguishing gas is expanded suddenly, and noise is generated, but in the injection head 1C1 of the embodiment, the outer circumference of the orifices 2 as the passage of fire extinguishing gas is covered with the casing 38 by way of the filler 39*a*1, and therefore the fire extinguishing gas passing through the orifices 2 is expanded gradually while passing through the filler 39*a*1, is hence prevented from being expanded suddenly when released into the atmosphere from the opening 38*a* of the casing 38, and the impulse waves generated by expansion of the fire extinguishing gas are weakened, thereby suppressing the noise generated when the fire extinguishing gas is released.

If there is any liquid flammable or the like nearby, the fire extinguishing gas is injected and the flammable splashes, and the range of flame and fire may be expanded, but the flow velocity of the fire extinguishing gas passing through the orifices 2 is substantially reduced while passing through the filler 39*a*1, and this problem can be solved at the same time.

In this case, the filler 39*a*1 may be made of a gas-permeable fibrous or porous material capable of eliminating disturbance of air stream, and in particular a porous matter made of a sinter of an inorganic material having a shape retaining performance (including metal, oxide of metal, and hydroxide of metal) may be used preferably.

Further, as shown in FIG. 4 (*b*), a tubular shielding member 39*c* having a bottom not allow to pass gas may be provided in the lower part of the space formed between the orifices 2 and the filler 39*a*1.

As a result, the fire extinguishing gas passing through the orifices 2*a* of the injection head 1C1 is once received in the shielding member 39*c*, and then passed into the filler 39*a*1, and hence the filler 39*a*1 is not damaged by the pressure of the fire extinguishing gas, so that the fire extinguishing gas can smoothly pass through the filler 39*a*1.

Incidentally, free space may not be formed between the orifices 2 of the injection head 1C1 and the filler 39*a*1, but by forming a free space, the fire extinguishing gas passing through the orifices 2 of the injection head 1C1 is once released into the space formed between the orifices 2 of the injection head 1C1 and the filler 39*a*1, and is diffused, so that the fire extinguishing gas can smoothly pass through the filler 39*a*1.

Other actions of the injection head 1C1 having silencing function for gas type fire extinguisher of the embodiment are similar to those of the injection head 1C having silencing function for gas type fire extinguisher of the third embodiment.

Figure 5:
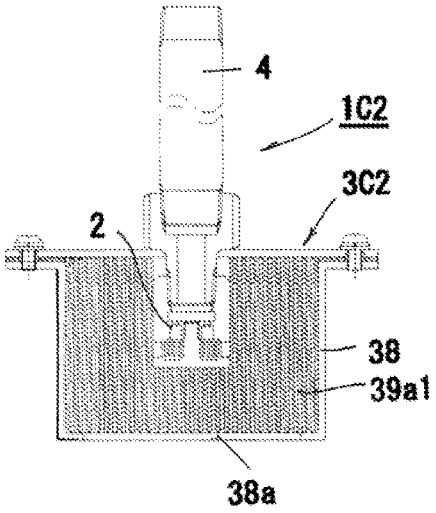
FIG. 5 is an explanatory diagram of a second modified example of the third embodiment of the injection head having silencing function for gas type fire extinguisher of the present invention.
Figure 5:
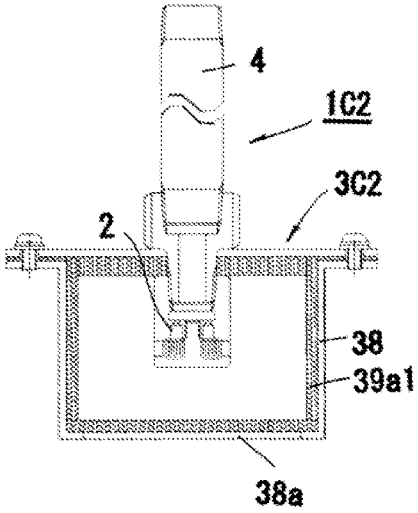

FIG. 5 shows a second modified example of the third embodiment.

In this injection head 1C2 having silencing function for gas type fire extinguisher, a silencer 3C2 is composed of a tubular casing 38 having an opening 38*a* as the passage of fire extinguishing gas, provided on the outer circumference of an opening deflected in a lateral direction provided with a deflector (deflection member) 5 of a disk shape (or a conical shape as shown in FIG. 9 (*b*)) at the outlet of a plurality of (six in the embodiment) orifices 2 opened in a downward direction, and a filler 39*a*1 with a bottom disposed in the casing 38 so as to cover the outer circumference of the opening directed to the lateral direction of the orifices 2.

Further, in this injection head 1C2, a gas-permeable material (not shown) capable of eliminating disturbance of air stream is disposed at the outlet of the orifices 2 opened in a downward direction, and slits are formed in the circumference, so that it can be covered with a gas-permeable cover member 39*d*.

In this case, the gas-permeable fibrous or porous material capable of eliminating disturbance of air stream is preferably disposed as closely as possible to the outlet of the orifices 2 so as to avoid voids causing disturbance of air stream.

This silencer 3C2 is intended to weaken the impulse waves caused by expansion of fire extinguishing gas, and suppress the noise generated upon release of the fire extinguishing gas.

More specifically, if the fire extinguishing gas passing through the orifices 2 of the injection head 1C2 is directly released into the atmosphere, the fire extinguishing gas is expanded suddenly, and noise is generated, but in the injection head 1C2 of the embodiment, the gas-permeable fibrous or porous material capable of eliminating disturbance of air stream is disposed at the outlet of the orifices 2 opened in the downward direction as the passage of the fire extinguisher, and the outer circumference of the opening directed in the lateral direction is covered with the casing 38 by way of the filler 39*a*1, and therefore the fire extinguishing gas passing through the orifices 2 is expanded gradually while passing through the gas-permeable fibrous or porous material capable of eliminating disturbance of air stream and the filler 39*a*1, is hence prevented from being expanded suddenly when released into the atmosphere from the opening 38*a* of the casing 38, and the impulse waves generated by expansion of the fire extinguishing gas are weakened, thereby suppressing the noise generated when the fire extinguishing gas is released.

If there is any liquid flammable or the like nearby, the fire extinguishing gas is injected and the flammable splashes, and the range of flame and fire may be expanded, but the flow velocity of the fire extinguishing gas passing through the orifices 2 is substantially reduced while passing through the gas-permeable fibrous or porous material capable of eliminating disturbance of air stream and the filler 39*a*1, and this problem can be solved at the same time.

In this case, the filler 39*a*1 may be made of a gas-permeable fibrous or porous material capable of eliminating disturbance of air stream, and in particular a porous matter made of a sinter of an inorganic material having a shape retaining performance (including metal, oxide of metal, and hydroxide of metal) may be used preferably.

The gas-permeable fibrous or porous material capable of eliminating disturbance of air stream disposed at the outlet of the orifices 2 opened in the downward direction as the passage of fire extinguishing gas is preferably made of glass wool, rock wool, steel wool, other metallic wool, porous matter of sinter of inorganic materials (including metal, oxide of metal, and hydroxide of metal) having a high shape retaining performance.

A cover member 39*d* may be made of punching metal, expanding metal, sinter metal, other plate material, rectifier of honeycomb structure, or others, depending on the material of the gas-permeable fibrous or porous material capable of eliminating disturbance of air stream, but may be eliminated, if possible, depending on the material of the gas-permeable fibrous or porous material capable of eliminating disturbance of air stream.

Further, as shown in FIG. 5 (*b*), a free space may be formed between the orifices 2 of the injection head IC1 and the filler 39*a*1.

As a result, the fire extinguishing gas passing through the orifices 2 of the injection head 1C2 is once released into the free space formed between the orifices 2 of the injection head IC1 and the filler 39*a*1, and is diffused, so that the fire extinguishing gas can smoothly pass through the filler 39*a*1.

Other actions of the injection head 1C2 having silencing function for gas type fire extinguisher of the embodiment are similar to those of the injection head 1C having silencing function for gas type fire extinguisher of the third embodiment.

Embodiment 4

In the foregoing embodiments, the silencing means is composed of the silencer 3A, 3B, or 3C disposed in the injection head 1A, 1B, or 1C, but a silencing effect may be obtained also by modifying the shape of the orifice 2.

Figure 6:
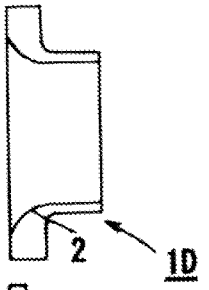
FIG. 6 is an explanatory diagram of a fourth embodiment of the injection head having silencing function for gas type fire extinguisher of the present invention.
Figure 6:
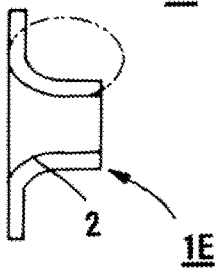
Figure 6:
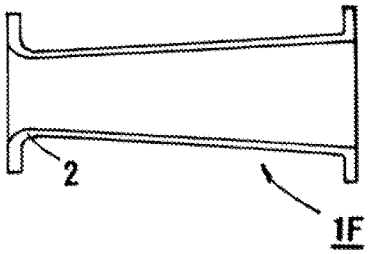
Figure 6:
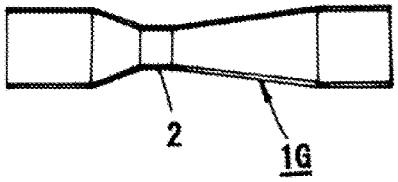
Figure 6:
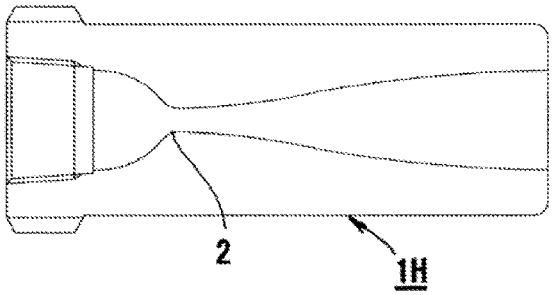

More specifically, the shape of the orifice 2 as silencing means is not particularly specified, but examples include, as shown in FIG. 6, an injection head 1D (FIG. 6 (*a*)) having an ISA nozzle, an injection head 1E (FIG. 6 (*b*)) having an elliptical nozzle, an injection head 1F (FIG. 6 (*c*)) having a nozzle type Venturi tube, and an injection head 1G (FIG. 6 (*d*)) having a conical Venuri tube, and a more specific example is an injection head 1H having a nozzle (laval nozzle) capable of deforming smoothly in the inner side shape of the conical Venturi tube as shown in FIG. 6 (*e*).

These injection heads 1D to 1H are intended to weaken the impulse waves caused by expansion of fire extinguishing gas, and suppress the noise generated upon release of the fire extinguishing gas.

More specifically, if the fire extinguishing gas passing through the orifices 2 of the injection heads 1D to 1H is directly released into the atmosphere, the fire extinguishing gas is expanded suddenly, and noise is generated, but in the injection heads 1D to 1H of the embodiment, the fire extinguishing gas passing through the orifices 2 is expanded gradually while passing through the injection heads 1D to 1H, is hence prevented from being expanded suddenly when released into the atmosphere, and the impulse waves generated by expansion of the fire extinguishing gas are weakened, thereby suppressing the noise generated when the fire extinguishing gas is released.

Thus, by forming the silencing means in the specified shape of the orifices, the silencing means may be formed in a simple structure, and the injection head may be formed in a compact design, and it may be directly applied in an existing facility.

Other actions of the injection heads 1D to 1H having silencing function for gas type fire extinguisher of the embodiment are similar to those of the injection head 1A having silencing function for gas type fire extinguisher of the first embodiment.

Embodiment 5

Similarly, a silencing effect may be also obtained only by a structure of disposing a gas-permeable fibrous or porous material capable of eliminating disturbance of air stream at the outlet of the orifices 2 (tubular casing 38 is omitted) as shown in the second modified example of the third embodiment.

In this case, the gas-permeable fibrous or porous material capable of eliminating disturbance of air stream is preferably disposed as closely as possible to the outlet of the orifices 2 so as to avoid voids causing disturbance of air stream.

Figure 7:
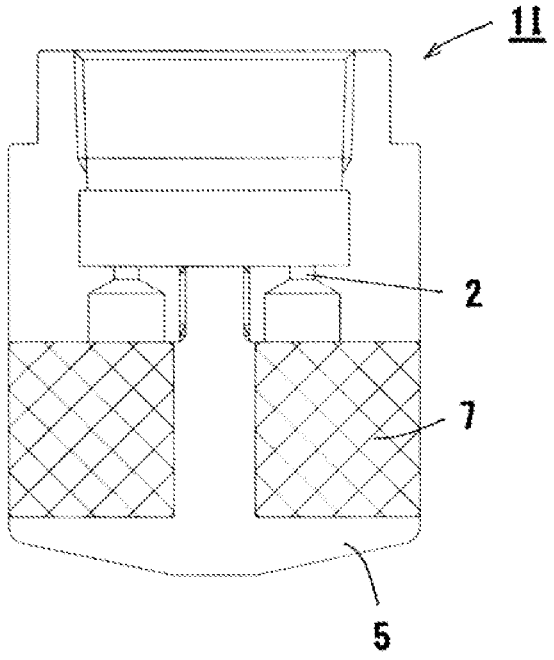
FIG. 7 is an explanatory diagram of a fifth embodiment of the injection head having silencing function for gas type fire extinguisher of the present invention.
Figure 7:
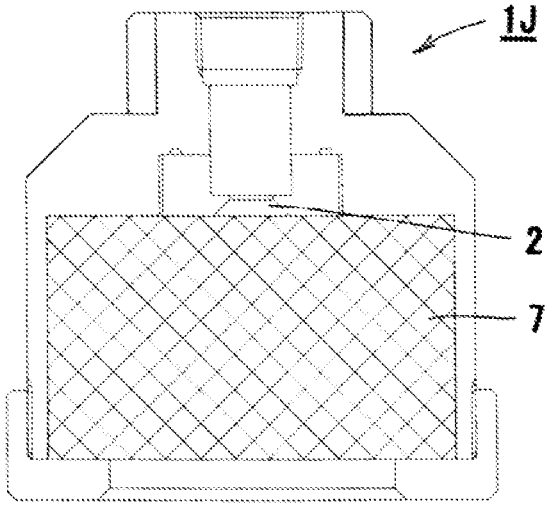

Specifically, as shown in FIG. 7, by disposing a gas-permeable fibrous or porous material 7 capable of eliminating disturbance of air stream at the outlet of the orifices 2 of injection heads 1I, 1J, the fire extinguishing gas passing through the orifices 2 is expanded gradually while passing through the gas-permeable fibrous or porous material 7 capable of eliminating disturbance of air stream, and hence prevented from being expanded suddenly when released into the atmosphere, and the impulse waves generated by expansion of the fire extinguishing gas are weakened, thereby suppressing the noise generated when the fire extinguishing gas is released.

Herein, the injection head 1I shown in FIG. 7 (*a*) includes a plurality of (six in the embodiment) orifices 2, and a disk-shaped (or conical-shaped as shown in FIG. 9 (*b*)) deflector (deflection member) 5 is provided at its outlet, and an opening is formed by deflecting in a lateral direction, and the injection head 1J shown in FIG. 7 (*b*) has an opening in a downward direction consecutive to one orifice 2.

The shape of the injection head and the orifice is not limited to the example of the embodiment.

In this case, the gas-permeable fibrous or porous material 7 capable of eliminating disturbance of air stream is preferably made of glass wool, rock wool, steel wool, other metallic wool, porous matter of sinter of inorganic materials (including metal, oxide of metal, and hydroxide of metal) having a high shape retaining performance, and may be made of a cover member composed of, as required, punching metal, expanding metal, sinter metal, other plate material, rectifier of honeycomb structure, or others, depending on the material thereof.

Thus, by composing the silencing means by using the gas-permeable fibrous or porous material 7 capable of eliminating disturbance of air stream disposed at the outlet of the orifices 2, the silencing means may be formed in a simple structure, and the injection head may be formed in a compact design, and it may be directly applied in an existing facility.

Other actions of the injection heads 1I and 1J having silencing function for gas type fire extinguisher of the embodiment are similar to those of the injection head 1C2 having silencing function for gas type fire extinguisher of the second modified example of the third embodiment.

Figure 8:
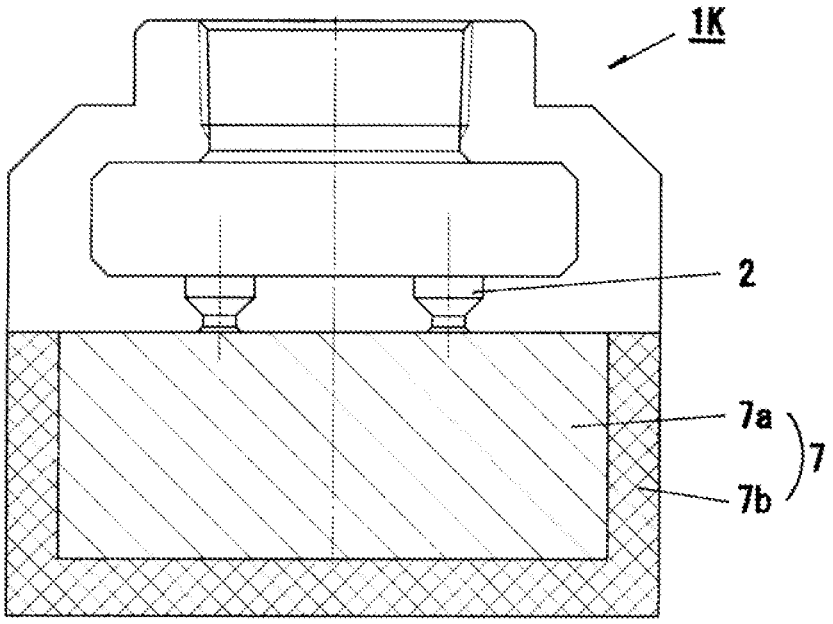
FIG. 8 is an explanatory diagram of a modified example of the fifth embodiment of the injection head having silencing function for gas type fire extinguisher of the present invention.
Figure 8:
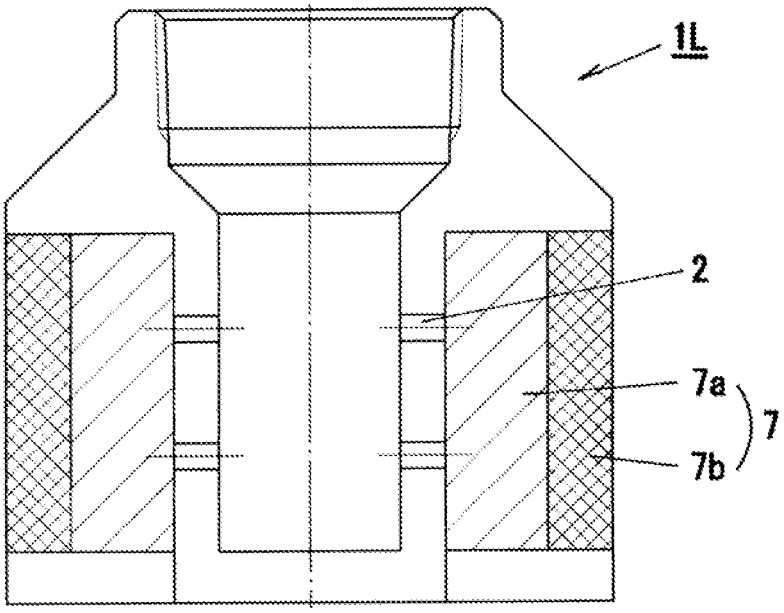

Incidentally, the gas-permeable fibrous or porous material 7 capable of eliminating disturbance of air stream disposed at the outlet of the orifices 2 is entirely composed of a homogeneous material, or as in injection heads 1K and 1L shown in FIG. 8, a fibrous or porous material changed in the pore size of voids in the gas passing direction may be used, for example, a fibrous or porous material reduced in the pore size of voids in the gas passing direction may be used.

More specifically, the injection head 1K shown in FIG. 8 (*a*) includes a plurality of orifices 2, and a three-dimensional reticular metal porous material 7*a* large in the pore size of voids in the center is disposed at the outlet, and a metal porous material 7*b* small in the pore size of voids is disposed on the outer circumference in layers, and a disk-shaped porous material 7 capable of eliminating disturbance of air stream is disposed, or the injection head 1L shown in FIG. 8 (*b*) includes a plurality of orifices 2, and a three-dimensional reticular metal porous material 7*a* large in the pore size of voids in the center is disposed at the outlet, and a metal porous material 7*b* small in the pore size of voids is disposed on the outer circumference in layers, and a tubular porous material 7 capable of eliminating disturbance of air stream is disposed.

The shape of the injection heads and the orifices, and the gas-permeable fibrous or porous material 7 capable of eliminating disturbance of air stream are not limited to the examples of the embodiments alone.

Table shows results of comparative tests of the injection head 1 shown in FIG. 8 (*a*), and the homogeneous material 7 capable of eliminating disturbance of air stream (same material as the metal porous material 7*a* large in the pore size of voids).

TABLE 1

| Flow rate of nitrogen gas | Injection head 1K | Homogenous material |
|---|---|---|
| 90 $m^3$/min | 108 dB | 117 dB |
| 125 $m^3$/min | 110 dB | 119 dB |

(Range of measuring frequency: 20 to 100 kHz)

As clear from the results of the comparative tests in Table 1, as the gas-permeable fibrous or porous material 7 capable of eliminating disturbance of air stream disposed at the outlet of the orifices 2, by using a material changed in the pore size of voids in the gas passing direction, for example, a material small in the pore size of voids in the gas passing direction, it has been confirmed that the noise generated upon release of fire extinguishing gas can be further suppressed.

Herein, the injection head having silencing function for gas type fire extinguisher of the present invention is described in a plurality of embodiments, but the invention is not limited to the illustrated embodiments alone, and, for example, various embodiments may be appropriately combined, or various structures capable of reducing the noise generated upon release of fire extinguishing gas may be used in the fire extinguisher, and it may be changed and modified in various forms within the scope not departing from the true spirit thereof.

INDUSTRIAL APPLICABILITY

The injection head having silencing function for gas type fire extinguisher of the present invention is capable of reducing the noise generated upon release of fire extinguishing gas, and is hence widely usable in various applications of gas type fire extinguishers using fire extinguishing gas, such as carbon dioxide, nitrogen, or fluorine compound, and applicable devices are not limited to newly installed gas type fire extinguishers, but include existing gas type fire extinguishers, only by exchanging the injection head or adding silencers.

The invention claimed is:

1. An injection head having a silencing function for a gas type fire extinguisher, the injection head comprising:

at least one orifice; and a metal porous material that retains its shape, wherein the metal porous material covers an entirety of an outlet of the at least one orifice and extends from the outlet of the at least one orifice in an outward radial direction with respect to a central axis of the injection head, and the metal porous material has an outer circumferential surface that is entirely uncovered and is directly exposed to the atmosphere, and a pore size of voids in the metal porous material is varied to be smaller in a gas passing direction.

2. The injection head according to claim 1, further comprising:

a deflector that abuts the metal porous material.

3. The injection head according to claim 2, wherein the deflector is located opposite of the at least one orifice, and the metal porous material is located between the at least one orifice and the deflector.

4. The injection head according to claim 1, wherein the metal porous material includes a first portion and a second portion.

5. The injection head according to claim 4, wherein at least one of the first portion of the metal porous material and the second portion of the metal porous material is in contact with a surface of a central portion of the injection head, the at least one orifice being formed in the central portion.

6. The injection head according to claim 4, wherein the voids in the metal porous material include voids in the first portion of the metal porous material and voids in the second portion of the metal porous material, and a pore size of the voids in the second portion of the metal porous material is smaller than a pore size of the voids in the first portion of the metal porous material.

7. The injection head according to claim 4, further comprising a deflector located opposite of the at least one orifice such that an outer circumferential surface of the second portion of the metal porous material is the outer circumferential surface of the metal porous material that is entirely uncovered and directly exposed to the atmosphere.

8. The injection head according to claim 4, wherein the first portion is thicker than the second portion.

9. The injection head according to claim 1, wherein the at least one orifice comprises a plurality of orifices.

10. The injection head according to claim 1, wherein the outlet of the at least one orifice is a different diameter than an inlet of the at least one orifice.

11. The injection head according to claim 1, wherein the metal porous material intersects a central longitudinal axis of the outlet of the at least one orifice.

12. The injection head according to claim 1, wherein the outlet of the at least one orifice does not extend past an end of the at least one orifice.

* * * * *